US009957591B2

(12) United States Patent
Kang

(10) Patent No.: US 9,957,591 B2
(45) Date of Patent: May 1, 2018

(54) ALUMINUM ALLOY AND VEHICLE PART USING THE SAME

(71) Applicant: Hyundai Motor Company, Seoul (KR)

(72) Inventor: Hee Sam Kang, Seoul (KR)

(73) Assignee: Hyundai Motor Company, Seoul (KR)

( * ) Notice: Subject to any disclaimer, the term of this patent is extended or adjusted under 35 U.S.C. 154(b) by 292 days.

(21) Appl. No.: 14/300,530

(22) Filed: Jun. 10, 2014

(65) Prior Publication Data

US 2015/0167127 A1 Jun. 18, 2015

(30) Foreign Application Priority Data

Dec. 18, 2013 (KR) ..... 10-2013-0158803

(51) Int. Cl.
*C22C 21/08* (2006.01)

(52) U.S. Cl.
CPC ..... *C22C 21/08* (2013.01)

(58) Field of Classification Search
CPC ..... C22C 21/08
See application file for complete search history.

(56) References Cited

U.S. PATENT DOCUMENTS

| | | | | |
|---|---|---|---|---|
| 5,178,686 | A | 1/1993 | Schmid et al. | |
| 2010/0074796 | A1 * | 3/2010 | Franke | C22F 1/05 |

FOREIGN PATENT DOCUMENTS

| | | | | |
|---|---|---|---|---|
| JP | 06145868 | | 5/1994 | |
| JP | 2007100205 | A | 4/2007 | |
| JP | 2011080118 | A | 4/2011 | |
| KR | 10-2012-0057402 | A | 6/2012 | |
| KR | 10-1212314 | | 6/2012 | |
| WO | WO 2011090451 | A1 * | 7/2011 | C22C 21/08 |

* cited by examiner

*Primary Examiner* — George Wyszomierski
*Assistant Examiner* — Janelle Morillo
(74) *Attorney, Agent, or Firm* — Mintz Levin Cohn Ferris Glovsky and Popeo, P.C.; Peter F. Corless

(57) ABSTRACT

An aluminum alloy and a vehicle part manufactured from the aluminum alloy are provided. The aluminum alloy includes about 8.5 to 11.0 wt % of Mg, about 3.5 to 5.8 wt % of Si, about 2.0 to 3.0 wt % of Cu and the balance of Al.

9 Claims, 3 Drawing Sheets

ALUMINUM ALLOY AND VEHICLE PART USING THE SAME

CROSS-REFERENCE(S) TO RELATED APPLICATION

The present application claims priority of Korean Patent Application Number 10-2013-0158803 filed on Dec. 18, 2013, the entire contents of which application is incorporated herein for all purposes by this reference.

TECHNICAL FIELD

The present invention relates to an aluminum alloy having substantially high heat resistance and wear resistance suitable for high-power engine parts, and to a vehicle part using the same. Therefore, the present invention provides an aluminum alloy which is lighter in weight and has substantially high heat resistance while being applicable to high-power engine parts, and more particularly, a novel aluminum alloy which is lighter in weight and has improved heat resistance compared to currently used aluminum-silicon-copper-nickel (Al—Si—Cu—Ni) alloys, thereby achieving both reduced weight of engine parts and improved durability thereof during substantially high temperature operation.

BACKGROUND

Recently, diverse environmental regulations have strengthened and research has been developed to suppress environmental pollution. According to such environmental regulations, extensive research pursuing improvement in fuel efficiency of a vehicle have been conducted, and also a demand for high-power car engines has increased.

As the engine power increases, the heat resistance limitation of a highly heat-resistant Al—Si—Cu—Ni alloy, especially an Al-12Si-3Cu-2Ni alloy, is estimated to be about 110 bar. With the aim of manufacturing pistons for higher-power engines (e.g., 130 bar or greater) in the future, a novel heat-resistant aluminum alloy with improved in high-temperature properties has to be developed above all, and furthermore, reducing the weight of engine parts is also required to improve fuel efficiency and decrease exhaust emissions.

The foregoing is intended merely to aid in the understanding of the background of the present invention, and is not intended to mean that the present invention falls within the purview of the related art that is already known to those skilled in the art.

SUMMARY

Accordingly, the present invention provides a technical solution to the above mentioned technical difficulties in the related art, and particularly provides an aluminum alloy having substantially high heat resistance and wear resistance suitable for high-power engine parts, and a vehicle part using the same.

In one aspect, the present invention provides an aluminum alloy, that may include about 8.5 to 11.0 wt % of magnesium (Mg), about 3.5 to 5.8 wt % of silicon (Si), about 2.0 to 3.0 wt % of copper (Cu) and a balance of aluminum (Al).

The ratio of Mg to Si (Mg/Si) may be about 1.47 to 3.10. The aluminum alloy may further comprise about 0.3 to 1.0 wt % of manganese (Mn). The structure of the aluminum alloy may include primary magnesium silicide ($Mg_2Si$) particles. The structure of the aluminum alloy may include Al—Mg—Cu intermetallic compound particles. The structure of the aluminum alloy may include Al—Mn intermetallic compound particles. The structure of the aluminum alloy may include primary $Mg_2Si$ particles, Al—Mg—Cu intermetallic compound particles and Al—Mn intermetallic compound particles together.

In another aspect, the present invention provides a vehicle part manufactured through casting and thermal treatment using the aluminum alloy having the above composition. The thermal treatment may be performed at about 200 to 250° C. for about 1.5 to 4.5 hr.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1A:
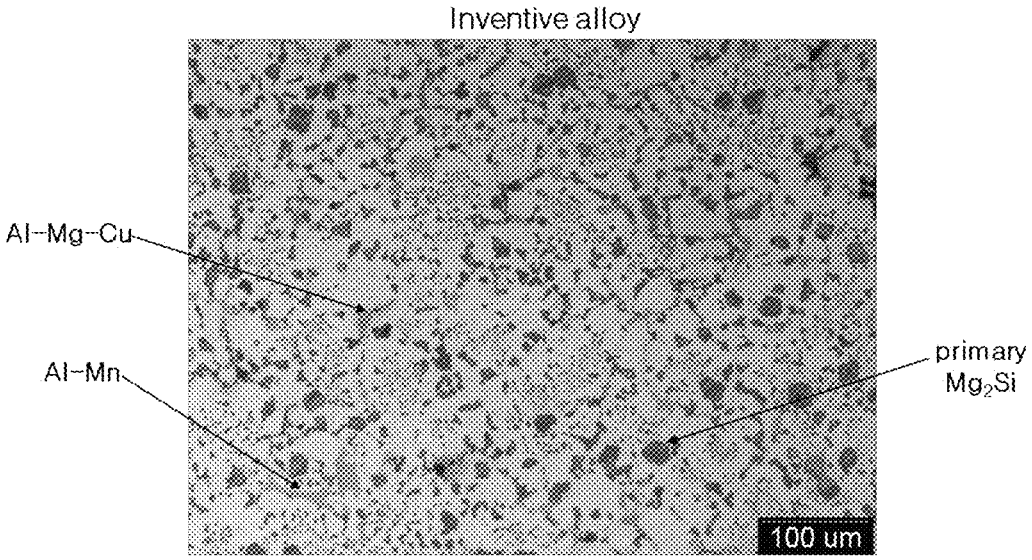
FIG. 1A shows an exemplary microscopic view of an aluminum alloy according to one exemplary embodiment of the present invention.

Hereinafter, an exemplary embodiment of the present invention will be described in detail. However, the exemplary embodiment is illustrative only but is not to be construed to limit the present invention, and the present invention is just defined by the scope of the claims as described below.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Hereinafter, a detailed description will be given of exemplary embodiments of the present invention with reference to the appended drawings.

In order to manufacture an aluminum alloy which is lighter in weight and has higher (e.g., improved) heat resistance than the currently used Al—Si—Cu—Ni alloys, an aluminum alloy according to one aspect of the present invention may include Al; of about 8.5 to 11.0 wt % of Mg, about 3.5 to 5.8 wt % of Si and about 2.0 to 3.0 wt % of Cu. In addition, the ratio of Mg/Si may be about 1.47 to 3.10 to produce an appropriate amount of primary $Mg_2Si$ particles having high heat resistance and wear resistance.

In conventional techniques, production of an intermetallic compound is suppressed despite the addition of Mg, Si and Cu. The ratio of Mg/Si is limited to about 1.98 to 2.5 to form a microstructure, and sonication is performed. Therefore, the alloy obtained from such techniques has a quasi-binary eutectic structure of Al—$Mg_2Si$. Furthermore, as the amount of alloy increases, eutectic conditions for a desired quasi-binary eutectic structure are very restricted, and the quality thereof may be deviated. To the contrary, according to exemplary aspect of the present invention, to increase heat resistance and wear resistance, a composite microstructure may be formed to include primary $Mg_2Si$ which is used as a main reinforcing phase; and a substantial amount of Al—Mg—Cu or Al—Mn intermetallic compound may be produced. The structure thereof may be applied to typical casting processes and may enable the fabrication of the alloy having higher heat resistance, lower density and higher wear resistance than commercially available alloys.

Figure 1B:
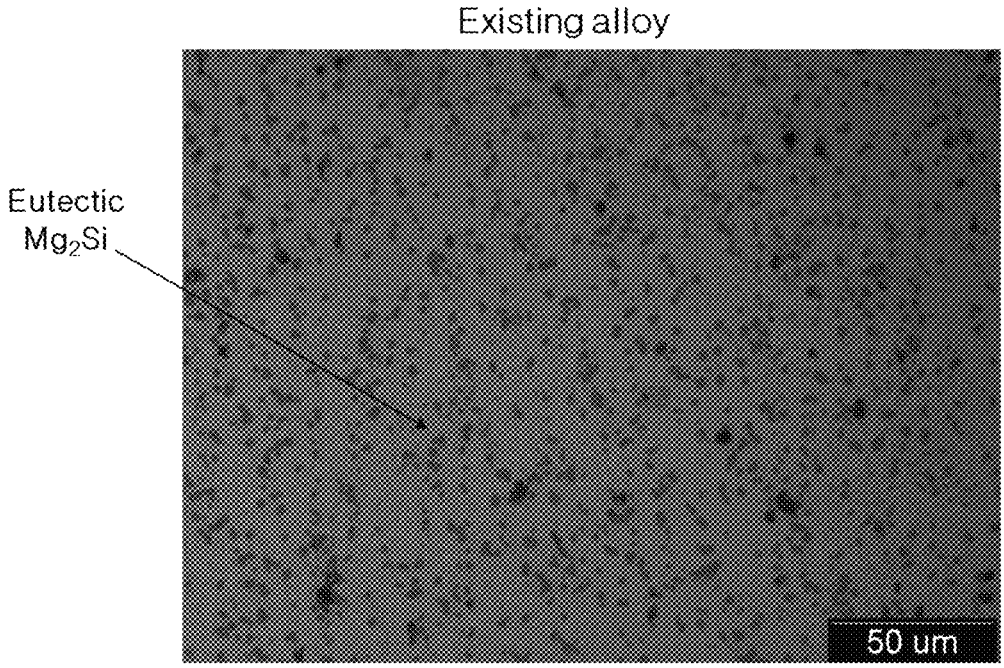
FIG. 1B Related Art
FIG. 1B shows an exemplary microscopic view of a conventional aluminum alloy.

FIGS. 1A and 1B show the microstructures of the alloys obtained from one exemplary embodiment of the present invention; and the quasi-binary eutectic structure mentioned in conventional techniques, respectively. As shown in FIG. 1A, the alloy according to one exemplary embodiment of the present invention may have a composite microstructure, in which primary $Mg_2Si$ particles (black) as a main reinforcing phase are distributed and also a variety of intermetallic compounds, such as Al—Mg—Cu, Al—Mn, etc., as a eutectic phase may be distributed together. In addition, in FIG. 1B, the quasi-binary eutectic structure may have eutectic $Mg_2Si$ particles finely distributed in an Al matrix. Therefore, to ensure such a composite microstructure in the aluminum alloy, the ratio of Mg/Si may be about 1.47 to 3.10.

In the case of the alloy having high heat resistance and wear resistance used in the present invention, the upper limit of the amount of Mg may be about 11.0 wt % and thus the density of the alloy may be decreased by about 7~9 wt % compared to existing alloys, thereby reducing the weights of parts using the same. Furthermore, primary $Mg_2Si$ particles may be used as a main heat-resistant reinforcing phase; and Al—Mg—Cu or Al—Mn intermetallic compounds may be formed, which may contribute to enhancing tensile strength and fatigue strength at a high temperature of 200° C. or greater, thereby increasing durability during high temperature operation.

Figure 2:
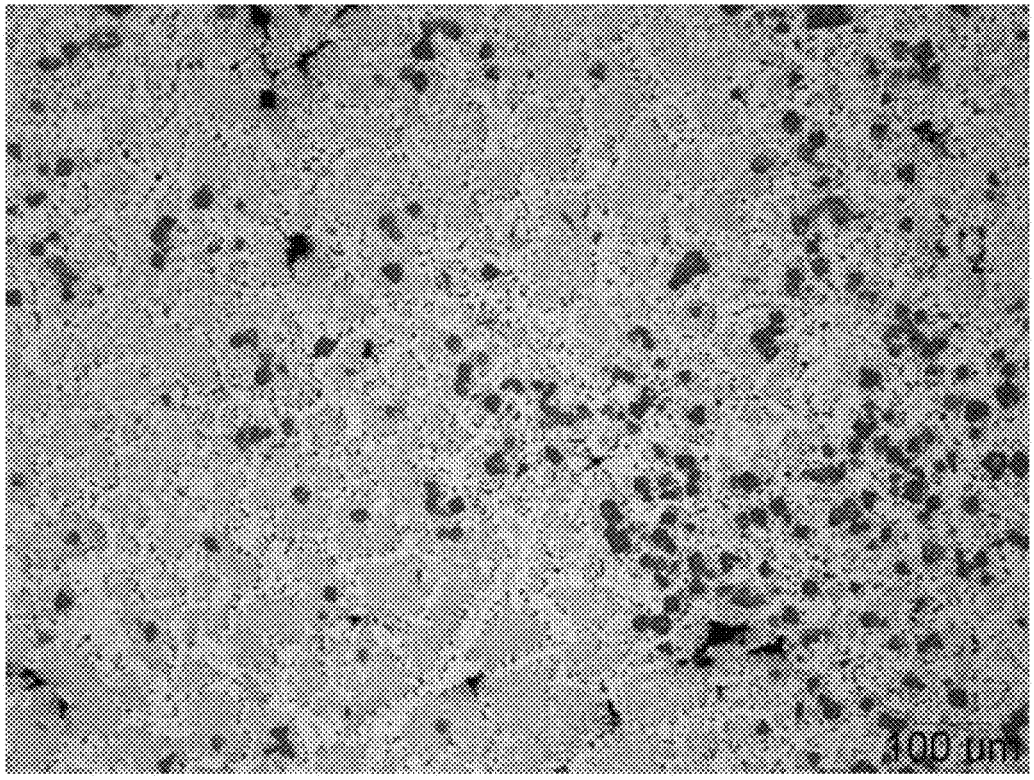
FIG. 2 shows an exemplary microscopic view of Si clustering due to the excessive addition of Si in the aluminum alloy.

In one exemplary embodiment of the present invention, the alloy may include mainly of Al, about 8.5 to 11.0 wt % of Mg, about 3.5 to 5.8 wt % of Si, and about 2.0 to 3.0 wt % of Cu. In particular, Mg may contribute to production of $Mg_2Si$ and AlMg intermetallic compounds which decrease the density of the alloy and enhance heat resistance at high temperature, and the amount thereof may be about 8.5 to 11.0 wt %. When the amount thereof is less than about 8.5 wt %, AlMgCu intermetallic compounds and $Mg_2Si$ particles having high heat resistance and wear resistance may not be obtained in sufficient amounts. In contrast, when the amount thereof exceeds 11.0 wt %, oxidation capability of the alloy may increase, thereby making it difficult to melt the alloy in the atmosphere, and a probability of generating cast defects, for example, underfills as shown in FIG. 2, due to lowered castability may increase.

In another aspect, Si may react with Mg and thus may contribtue to production of $Mg_2Si$ particles having high heat resistance and wear resistance. When the amount thereof is less than about 3.5 wt %, primary $Mg_2Si$ particles may not be formed, thereby making it difficult to enhance heat resistance and wear resistance. In addition, when the amount thereof exceeds 5.8 wt %, formation of coarse primary $Mg_2Si$ particles and clustering thereof may occur, thereby undesirably deteriorating heat resistance and mechanical properties. Thus, the ratio of Mg/Si necessary for formation of the particles having high heat resistance and wear resistance may be in a range of about 1.47 to 3.10.

In another aspect, Cu may contribute to formation of Al—Cu—Mg intermetallic compound particles which are another heat-resistant material by reacting with Mg. When the amount thereof is less than about 2.0 wt %, improvements in the heat-resistance may become insignificant. In addition, when the amount thereof exceeds 3.0 wt %, additional reinforcement effects may become insignificant. Hence, the amount of Cu may be in a range of about 2.0 to 3.0 wt %.

Below is a description of the examples of the present invention with the comparative examples, which are set forth to illustrate, but are not construed to limit the present invention. In the examples and comparative examples, with regard to formation of heat-resistant $Mg_2Si$ particles in an appropriate amount to impart high heat resistance to the Al—Mg—Si—Cu—Mn alloy according to the present invention, the available range of the amount of Si depending on the amount of Mg was determined.

When the amount of Mg is about 8.0 wt %, the range of Si in which $Mg_2Si$ particles may be formed in an appropriate amount may not be maintained. When the amount of Mg is 8.5 wt % or greater, the available range of the amount of Si which enables mass production may be maintained. When the amount of Mg exceeds 11 wt %, fluidity of the melt composite may decrease, a substantial number of underfills which are cast defects as shown in FIG. 2 may be generated, thereby undesirably deteriorating mass production. Hence, the amount of Mg may be in a range of about 8.5 to 11 wt %. In connection above, the amount of Si may be in a range of about 3.4 wt % to 5.8 wt % to produce $Mg_2Si$ in an appropriate amount. When the amount of Si exceeds 5.8 wt %, $Mg_2Si$ clustering may be caused, thereby making it difficult to obtain desired properties and increasing defective rates of products.

In the other examples and comparative examples of Table 1, the mechanical properties of the Al—Mg—Si—Cu—Mn alloy according to the present invention were evaluated. The mechanical properties of the alloy were measured by varying the amount of Cu in the Al-10Mg-5Si—0.5Mn alloy as seen in Table 1.

TABLE 1

Changes in mechanical properties of Al—10Mg—5Si—0.5Mn alloy depending on the amount of Cu

| | Al | Mg | Si | Mn | Cu | Tensile Strength (MPa) | Yield Strength (Mpa) |
|---|---|---|---|---|---|---|---|
| C. Ex. | Remainder | 10 | 5 | 0.5 | 1.8 | 225 | 125 |
| C. Ex. | Remainder | 10 | 5 | 0.5 | 1.9 | 225 | 125 |
| Ex. | Remainder | 10 | 5 | 0.5 | 2.0 | 305 | 175 |
| | Remainder | 10 | 5 | 0.5 | 2.2 | 315 | 180 |
| | Remainder | 10 | 5 | 0.5 | 2.7 | 295 | 190 |
| | Remainder | 10 | 5 | 0.5 | 3.0 | 305 | 190 |

As shown in Table 1, when the amount of Cu is 2 wt % or greater, mechanical properties are improved; and mechanical properties may be similarly maintained when the amount of Cu increases up to 3 wt %. Thus, the effect obtainable by the additional use of Cu may be regarded as insignificant.

In additional examples, pistons were manufactured using alloys having different compositions, and the strength thereof was evaluated at room temperature and high temperature. The results are shown in Table 2.

TABLE 2

Results of evaluation of properties at room temperature and high temperature in the present invention and the conventional technique

| | Present invention | Conventional technique |
|---|---|---|
| Material | Al—10Mg—5.0Si—0.6Mn—2.4Cu (Inventive Alloy) | Al—12.2Si—3.2Cu—2.1Ni (Existing Alloy) |
| Room Temp. Tensile Strength | 228 MPa | 230 MPa |
| Degradation of Strength (350° C., 100 hr Exposure) | 190 MPa | 180 MPa |
| Tensile Strength at High Temp. (350° C.) | 90 MPa | 80 MPa |
| Fatigue Strength at High Temp. (350° C.) | 65 MPa | 50 MPa |

As shown in Table 2, the durability of the novel light alloy having high heat resistance according to the present invention is increased by about 10 to 30% in the high temperature range, compared to the existing mass-produced alloy. In the aluminum alloy having the above structure and the vehicle part using the same, the novel light alloy having high heat resistance according to the present invention may have durability increased by about 10 to 30% and also density (e.g., weight) may decrease by about 7 to 9% because of Mg content effects, compared to the existing alloy. When such an alloy is applied to high-power engine parts, both durability and lightness may be achieved.

As described hereinbefore, the present invention provides an aluminum alloy and a vehicle part using the same. According to the present invention, durability of the novel light alloy having high heat resistance may be increased by about 10 to 30% and the density (weight) thereof may be decreased by about 7 to 9% due to Mg content effects, compared to the existing alloy. Therefore, such an alloy may exhibit both durability and lightness when applied to high-power engine parts.

Although the exemplary embodiments of the present invention depicted in the drawings have been disclosed for illustrative purposes, those skilled in the art will appreciate that various modifications, additions and substitutions are possible, without departing from the scope and spirit of the invention as disclosed in the accompanying claims.

What is claimed is:

1. An aluminum alloy, comprising:
10.0 to 11.0 wt % of magnesium (Mg);
3.5 to 5.8 wt % of silicon (Si);
2.2 to 3.0 wt % of copper (Cu); and
a balance of aluminum (Al).

2. The aluminum alloy of claim 1, wherein a ratio of Mg to Si is 1.47 to 3.10.

3. The aluminum alloy of claim 1, further comprising:
0.3 to 1.0 wt % of manganese (Mn).

4. The aluminum alloy of claim 1, wherein a structure of the aluminum alloy includes primary magnesium silicide ($Mg_2Si$) particles.

5. The aluminum alloy of claim 1, wherein the structure of the aluminum alloy includes Al—Mg—Cu intermetallic compound particles.

6. The aluminum alloy of claim 1, wherein the structure of the aluminum alloy includes Al—Mn intermetallic compound particles.

7. The aluminum alloy of claim 1, wherein the structure of the aluminum alloy includes primary $Mg_2Si$ particles, Al—Mg—Cu intermetallic compound particles, and Al—Mn intermetallic compound particles together.

8. A vehicle part manufactured by casting and thermal treatment using the aluminum alloy of claim 1.

9. The vehicle part of claim 8, wherein the thermal treatment is performed at about 200 to 250° C. for about 1.5 to 4.5 hr.

* * * * *